US009975362B1

(12) United States Patent
Kobayashi et al.

(10) Patent No.: US 9,975,362 B1
(45) Date of Patent: May 22, 2018

(54) PRINTER

(71) Applicant: TOSHIBA TEC KABUSHIKI KAISHA, Shinagawa-ku, Tokyo (JP)

(72) Inventors: Takeshi Kobayashi, Shimizu Sunto Shizuoka (JP); Kazuaki Sugimoto, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/460,444

(22) Filed: Mar. 16, 2017

(30) Foreign Application Priority Data

Feb. 1, 2017 (JP) ..... 2017-016890

(51) Int. Cl.
*B41J 29/02* (2006.01)
*B41J 11/00* (2006.01)

(52) U.S. Cl.
CPC ..... *B41J 29/02* (2013.01); *B41J 11/0045* (2013.01)

(58) Field of Classification Search
CPC ..... B41J 29/026; B41J 29/023; B41J 29/02; B41J 29/00; B41J 29/13; B41J 29/54; B41J 11/0045; B41J 11/04; B41J 15/04; B41J 15/044; B41J 3/4075; B41J 32/00
See application file for complete search history.

(56) References Cited

FOREIGN PATENT DOCUMENTS

JP 2001-80130 3/2001

*Primary Examiner* — Kristal Feggins
(74) *Attorney, Agent, or Firm* — Amin, Turocy & Watson LLP

(57) ABSTRACT

An embodiment provides a printer including a housing; a rotation body that is accommodated in the housing and rotates to transport a sheet; a printing unit that is provided in a transport path of the sheet and prints information on a transported sheet; a discharging unit that discharges a printed sheet to an outside of the housing; and a cover that is capable of moving between an open position at which the discharging unit is opened and a closed position at which the discharging unit is blocked, and moves from the closed position to the open position in response to a rotation of the rotation body.

4 Claims, 5 Drawing Sheets

PRINTER

CROSS-REFERENCE TO RELATED APPLICATION

This application is based upon and claims the benefit of priority from Japanese Patent Application No. 2017-016890, filed Feb. 1, 2017, the entire contents of which are incorporated herein by reference.

FIELD

Embodiments described herein relate generally to a printer.

BACKGROUND

In the related art, a printer that prints information on a sheet, in particular, a portable printer on which a battery is mounted and which is portable exists. Such a printer is used, for example, when a delivery dealer delivers packages to homes. In addition, for example, the printer is also used when performing inventory management in, for example, a warehouse or the like.

The delivery dealer wears, for example, a printer on a body and delivers packages to homes. In this case, a sheet (for example, a delivery record or an absent communication slip) on which various types of information are printed on a roll sheet accommodated inside the printer is discharged from an opening portion using the printer.

However, when the printer is used outdoors in rainy weather, water droplets may intrude through the opening portion of the printer. When the water droplets intrude into the printer, there is a problem that bad influence (for example, short circuit of an electrical system) is given to devices inside the printer.

DETAILED DESCRIPTION

An object to be solved by embodiments is to provide a printer into which water droplets are unlikely to intrude.

In general, according to one embodiment, a printer of an embodiment includes a housing; a rotation body that is accommodated in the housing and rotates to transport a sheet; a printing unit that is provided in a transport path of the sheet and prints information on a transported sheet; a discharging unit that discharges a printed sheet to an outside of the housing; and a cover that is capable of moving between an open position at which the discharging unit is opened and a closed position at which the discharging unit is blocked, and moves from the closed position to the open position in response to a rotation of the rotation body.

Hereinafter, an embodiment of a printer will be described in detail with reference to the annexed drawings. In the embodiment described below, a portable printer which is a portable type will be described as an example of the printer. Moreover, the embodiment described below is an embodiment of a printer and does not limit configurations and specifications thereof, and the like.

Figure 1:
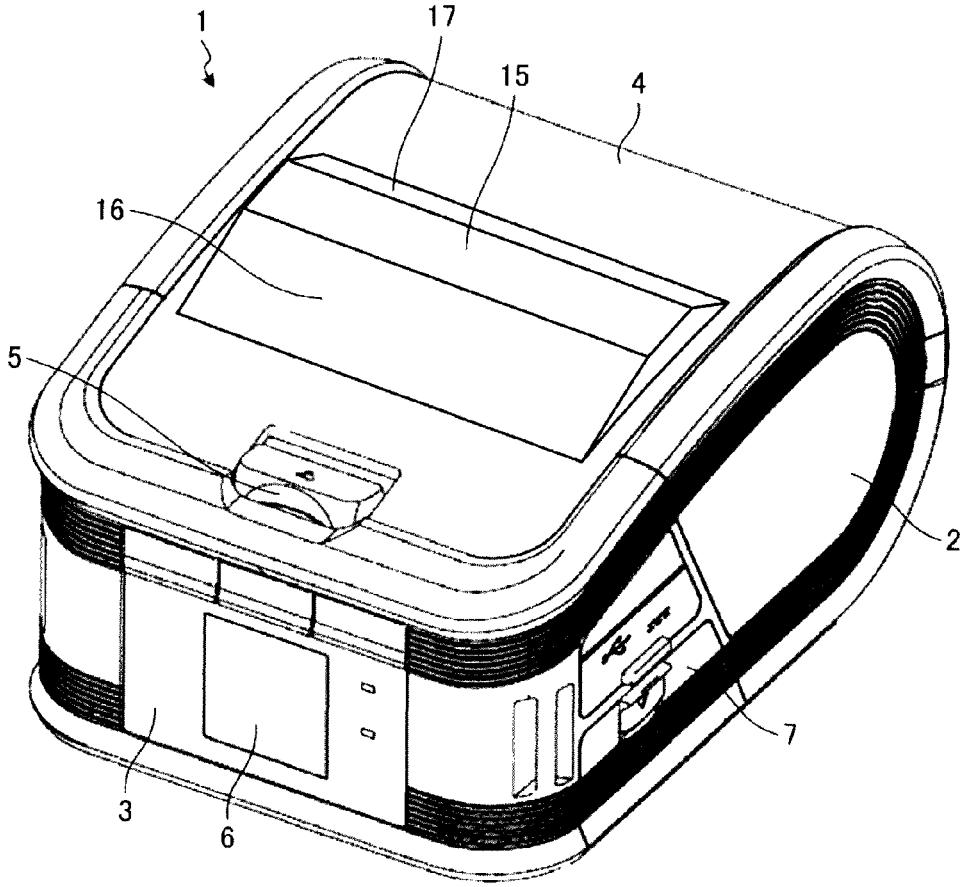
FIG. 1 is a perspective view illustrating an example of an external configuration of a portable printer according to an embodiment.

FIG. 1 is a perspective view illustrating an example of an external configuration of a portable printer 1 according to an embodiment. As illustrated in FIG. 1, a portable printer 1 includes a housing 2. The housing 2 has an internal structure capable of accommodating a roll-shaped sheet 21 (see FIG. 3) in which a printing sheet made of thermal paper is wound. Various control systems including transport of a sheet which is described below, a printer engine, and the like (see FIG. 6) are accommodated on an inside of the housing 2.

The housing 2 includes a lid 7 which is capable of opening and closing for accommodating a battery (not illustrated) for driving the portable printer 1. The accommodated battery supplies power to the portable printer 1. The portable printer 1 is driven by power supplied from the battery.

A front portion 3 of the housing 2 is provided with a display unit 6. The display unit 6 notifies that printing information is received. The display unit 6 displays various types of information in response to an operation when an operation unit 37 (see FIG. 6) is operated. The display unit 6 also displays a remaining amount of the accommodated battery.

The portable printer 1 is provided with a lid 4 an inside of which is opened. The lid 4 is capable of rotating between an open position and a closed position with respect to the housing 2. In FIG. 1, the lid 4 rotates upward from the housing 2. In a state where the lid 4 rotates to the open position, it is possible to install the roll-shaped sheet 21. In a state where the lid 4 rotates to the open position, a sheet P (see FIG. 2) is drawn out from a tip of the installed roll-shaped sheet 21 and is set at a predetermined position.

The lid 4 is provided with a lock mechanism 5 for locking the lid 4 to the housing 2. As the lock mechanism 5 locks the lid 4, the lid 4 is locked at the closed position with respect to the housing 2. As the lock mechanism 5 releases the lock, the lid 4 is capable of rotating to the open position.

Next, a cover 15 will be described. The cover 15 is rotatably attached to a support shaft 11 which is described below and rotates (moves) between the open position and the closed position with respect to the lid 4. In a state where the cover 15 is positioned at the open position with respect to the lid 4, the portable printer 1 discharges a printed sheet P to the outside. In a state where the cover 15 is positioned at the closed position with respect to the lid 4, the portable printer 1 shuts out intrusion of water droplets, dust, and foreign matters from the outside to the inside.

The cover 15 includes an opening and closing unit 16 and an abutting unit 17. As the opening and closing unit 16 is in close contact with the lid 4, the cover 15 is positioned at the closed position. As the opening and closing unit 16 is away from the lid 4, the cover 15 rotates toward the open position. The abutting unit 17 abuts against a mold wall 23 which is described below, thereby regulating a range in which the cover 15 rotates toward the open position. In a state of abutting against the abutting unit 17, the cover 15 is positioned at the open position.

Figure 2:
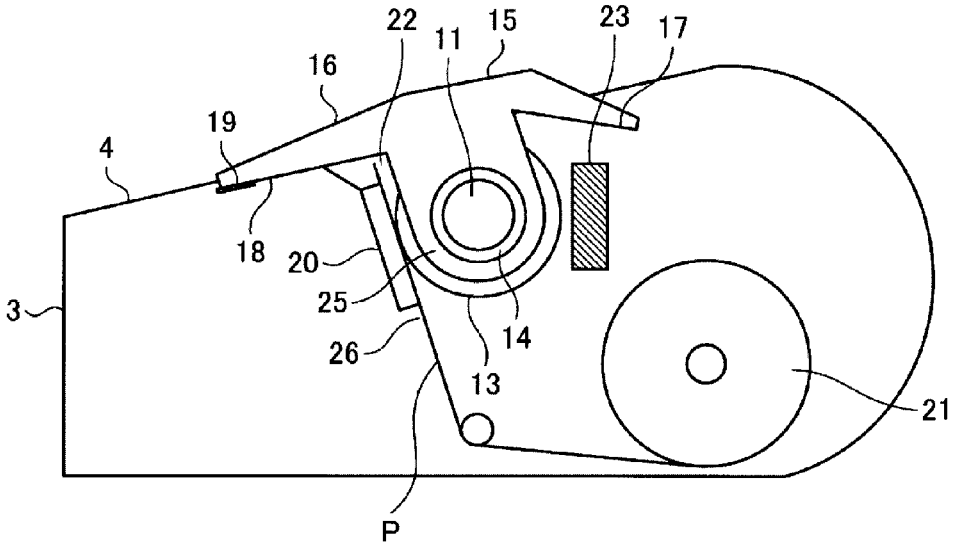
FIG. 2 is a sectional view of the portable printer according to the embodiment.
Figure 3:
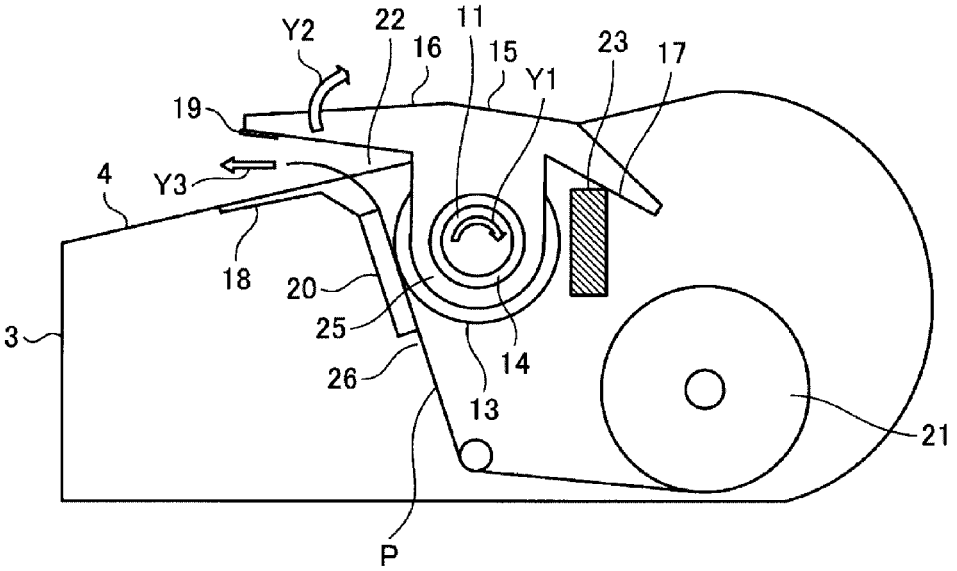
FIG. 3 is a sectional view of the portable printer according to the embodiment.
Figure 4:
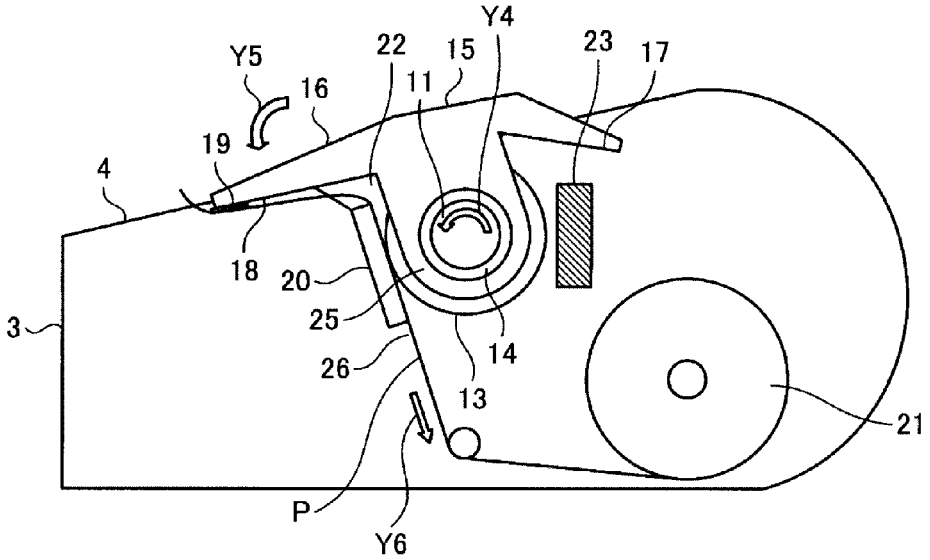
FIG. 4 is a sectional view of the portable printer according to the embodiment.

Next, an internal structure of the portable printer 1 will be described. FIGS. 2 to 4 are sectional views of an internal structure of the portable printer according to the embodiment, which is taken along a side surface thereof. The sectional views of FIGS. 2 to 4 are sectional views taken along line A-A of FIG. 5 which is described below.

FIG. 2 is a view of a state where the sheet P is not transported. In FIG. 2, the portable printer 1 includes a printing unit 20, the support shaft 11, a platen roller 13, and a ring unit 14 (ring-shaped object) that is a sliding body. The support shaft 11 and the platen roller 13 are collectively referred to as a rotation body. That is, the rotation body has the support shaft 11 and the platen roller 13. The ring unit 14 is a hollow circular object. The ring unit 14 may be a circular object a periphery of which is completely surrounded or a circular object a part of which is cut.

The printing unit 20 has a line-shaped thermal head in which heating elements are arranged in a line in a direction orthogonal to a transporting direction of the sheet P. When a voltage is applied to the printing unit 20 in accordance with printing information, the heating elements to which a voltage is applied are heated and thereby the printing unit 20 performs printing on the sheet P.

The support shaft 11 is rotatably and pivotally supported on a frame (not illustrated) provided in the housing 2. The platen roller 13 is fixed to the support shaft 11 and rotates with the support shaft 11. When the support shaft 11 positively rotates, the platen roller 13 also positively rotates. When the support shaft 11 reversely rotates, the platen roller 13 also reversely rotates.

Here, the positive rotation is a direction in which the rotation body rotates for transporting the sheet in an arrow Y3 direction (discharging direction) (see FIG. 3). The arrow Y3 direction is a direction in which the sheet P is drawn out from the sheet 21 and is transported to the printing unit 20 provided in a transport path. The arrow Y3 direction is a rotating direction of the rotation body for discharging the sheet P on which printing is performed by the printing unit 20 from the portable printer 1 to the outside.

The reverse rotation is a rotating direction of the rotation body for transporting the sheet in an arrow Y6 direction (opposite direction) (see FIG. 4) that is a direction opposite to the arrow Y3 direction (see FIG. 3).

The ring unit 14 that is the sliding body has a hollow ring shape. The ring unit 14 is fitted to an outer periphery of the support shaft 11. The ring unit 14 is formed of, for example, resin having an appropriate friction coefficient on an outer peripheral surface and an inner peripheral surface. When the support shaft 11 is rotated by sliding friction (frictional force) having a predetermined size generated between the inner peripheral surface of the ring unit 14 and the outer peripheral surface of the support shaft 11, the ring unit 14 rotates in the same direction as that of the support shaft 11 together with the support shaft 11. However, when a rotation restraining force is applied to the ring unit 14 from the outside, slip occurs between the outer peripheral surface of the support shaft 11 and the inner peripheral surface of the ring unit 14 against the frictional force of the sliding friction, and although the support shaft 11 rotates, the ring unit 14 does not rotate. In a state where the ring unit 14 does not rotate, the ring unit 14 receives a biasing force to rotate in the rotating direction of the support shaft 11 from the rotating support shaft 11.

The cover 15 is provided with a foot portion 25. The foot portion 25 has a circular hole having an inner peripheral surface. The hole of the foot portion 25 is fitted to an outer periphery of the ring unit 14. When the ring unit 14 is rotated by sliding friction of a predetermined size generated between the inner peripheral surface of the foot portion 25 and the outer peripheral surface of the ring unit 14, the cover 15 is rotated in the same direction as that of the ring unit 14 together with the ring unit 14. However, when a rotation restraining force is applied to the cover 15 from the outside, slip occurs between the inner peripheral surface of the foot portion 25 and the outer peripheral surface of the ring unit 14 against the frictional force of the sliding friction, and although the ring unit 14 rotates, the cover 15 does not rotate. In a state where the cover 15 does not rotate, the cover 15 receives a biasing force from the ring unit 14, which is rotated, to be rotated in the rotating direction of the ring unit 14.

Moreover, in the embodiment, the sliding friction occurs both between the support shaft 11 and the ring unit 14, and between the ring unit 14 and the cover 15. However, the sliding friction may occur only at one of the portions between the support shaft 11 and the ring unit 14, and between the ring unit 14 and the cover 15, and the other may be fixed so as not to be rotated to each other.

The columnar platen roller 13 is fixed to the support shaft 11. Therefore, the support shaft 11 is rotated in the same direction as that of the platen roller 13 when being rotated. The platen roller 13 is disposed at a position facing the printing unit 20 disposed in a transport path 26 in which the sheet P is transported. Since the printing unit 20 is biased toward the platen roller 13 by a spring or the like, the printing unit 20 is pressed against the outer peripheral surface of the platen roller 13.

The housing 2 accommodates the roll-shaped sheet 21. The sheet P which is drawn out from the sheet 21 and is guided to the transport path 26 is pinched between the printing unit 20 and the platen roller 13.

The printing unit 20 performs printing with respect to the pinched sheet P. A discharging unit 22 is provided on a downstream side from the printing unit 20 in the transporting direction of the sheet P. The discharging unit 22 has an opening portion through which the printed sheet P is discharged to the outside.

The lid 4 has a recessed portion 18 that is recessed downward from a surface portion of the lid 4 in FIG. 2. The recessed portion 18 is somewhat recessed downward (for example, substantially 1 mm) from an upper surface of the lid 4.

A cutter blade 19 on a plane is attached to a tip of the opening and closing unit 16 of the cover 15. The cutter blade 19 protrudes somewhat (for example, substantially 1 mm) in a front direction (left direction in FIG. 2) that is a discharging direction of the sheet P from the tip of the opening and closing unit 16 to be attached to the tip thereof.

As illustrated in FIG. 2, in a state where the cover 15 is positioned at the closed position, the opening and closing unit 16 and the cutter blade 19 of the cover 15 are in a state of being entered into the recessed portion 18. That is, in a state where the cover 15 is positioned at the closed position, the cutter blade 19 is positioned at a position of the cover 15 which does not protrude to the outside. Therefore, in a state where the cover 15 is positioned at the closed position, a person does not touch the cutter blade 19.

When the cover 15 rotates toward the open position, the opening and closing unit 16 (that is, the cover 15) moves to the open position. Therefore, when the abutting unit 17 of the cover 15 abuts against the mold wall 23, further rotation of the cover 15 in the same direction is suppressed. The mold wall 23 is a part of the frame which, for example, is provided in the housing 2. When the abutting unit 17 abuts against the mold wall 23, the rotation of the cover 15 stops and further rotation of the cover 15 is suppressed. The stopped position is the open position of the cover 15.

FIG. 3 is a view illustrating a state where the support shaft 11 and the platen roller 13 positively rotate. In FIG. 3, the support shaft 11 and the platen roller 13 positively rotate in an arrow Y1 direction. Then, the cover 15 rotates in an arrow Y2 direction from the closed position due to the sliding friction generated between the ring unit 14 and the cover 15. As the cover 15 rotates in the arrow Y2 direction, the discharging unit 22 is opened. The abutting unit 17 abuts against the mold wall 23, the rotated cover 15 stops at the open position. That is, the cover 15 is positioned at the open position. Moreover, the support shaft 11 and the ring unit 14, which are positively rotated, configure an entirety or a part of an opening mechanism.

When the platen roller 13 is positively rotated, the sheet P moves in the discharging direction. The printing unit 20 performs printing on the sheet P based on input printing information by control of a control unit 300, which is described below (see FIG. 6). The printed sheet P is transported toward the discharging unit 22 in the discharging direction. The transported sheet P is transported from the opened discharging unit 22 to the tip of the opening and closing unit 16 along a lower surface of the opening and closing unit 16 in the arrow Y3 direction. The sheet P, which reaches the tip of the opening and closing unit 16, is discharged to the outside of the portable printer 1.

FIG. 4 is a view illustrating a state where the support shaft 11 and the platen roller 13 are reversely rotated. When printing on the sheet P by the printing unit 20 is completed and the discharge of the sheet P from the discharging unit 22 is completed, the control unit 300 allows the positive rotation of the support shaft 11 and the platen roller 13 to be stopped. Therefore, the control unit 300 allows the support shaft 11 and the platen roller 13 to be reversely rotated at a predetermined amount. Moreover, the support shaft 11 and the ring unit 14, which are reversely rotated, configure an entirety or a part of a closing mechanism.

In FIG. 4, the support shaft 11 and the platen roller 13 are reversely rotated in an arrow Y4 direction. Then, the cover 15 is rotated (moved) from the open position in an arrow Y5 direction by the sliding friction generated between the ring unit 14 and the cover 15. As the cover 15 is rotated in the arrow Y5 direction, the opening and closing unit 16 is moved to the closed position. When the opening and closing unit 16 is moved to the closed position, the discharging unit 22 is closed by the cover 15. The sheet P is transported by a predetermined distance in the arrow Y6 direction by the reverse rotation of the platen roller 13.

The opening and closing unit 16 abuts against the recessed portion 18, the rotated cover 15 stops, and the cover 15 is positioned at the closed position. That is, the closing mechanism allows the cover 15 to be moved to the closed position. In addition, the cutter blade 19 also abuts against the recessed portion 18. That is, the cutter blade 19 is positioned at a position slightly entered downward from the lid 4. Therefore, an operator of the portable printer 1 does not directly touch the cutter blade 19.

In this state, the sheet P is held between the opening and closing unit 16 and the recessed portion 18. The operator of the portable printer 1 cuts the printed sheet P, which is discharged to the outside in this state, using the cutter blade 19. That is, the operator grasps the sheet P, which is discharged to the outside, and pulls the sheet P from one side to the other side while abutting against the cutter blade 19 to tear the sheet P. Therefore, the cutter blade 19 cuts the sheet P.

Moreover, as illustrated in FIG. 3, in a state where the transport of the sheet in the discharging direction is completed, the operator of the portable printer 1 may cut the discharged sheet P against the cutter blade 19. That is, since the sheet P is pinched between the printing unit 20 and the platen roller 13, the operator may cut the sheet P in a state where the cover 15 is positioned at the open position.

Figure 5:
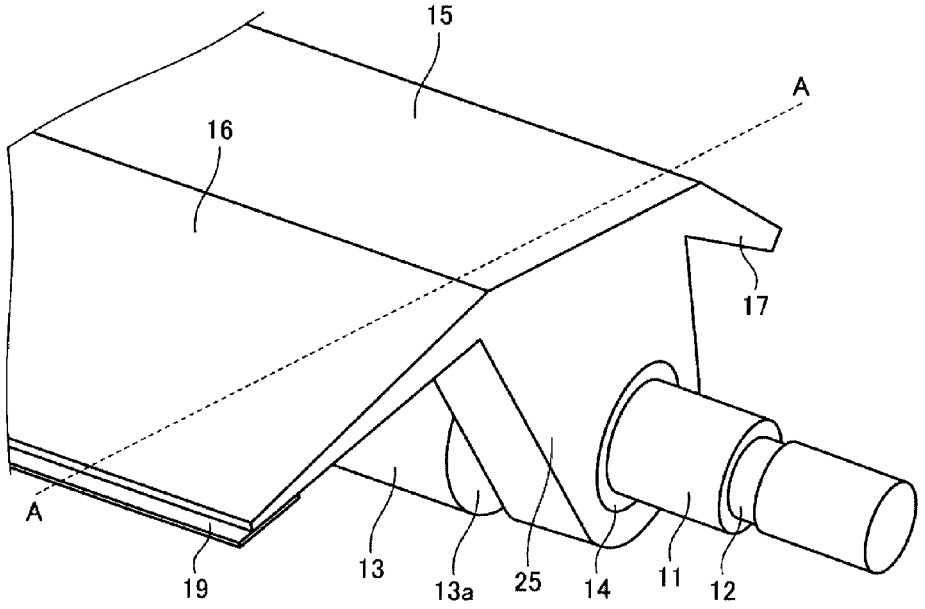
FIG. 5 is a perspective view illustrating a part of an internal structure of the portable printer according to the embodiment.

Next, an attachment state of the support shaft 11, the ring unit 14, and the cover 15 will be described. FIG. 5 is a perspective view illustrating a part of a state where the ring unit 14 is fitted to the outer peripheral surface of the support shaft 11 and the cover 15 is fitted to the outer peripheral surface of the ring unit 14.

The support shaft 11 is rotatably and pivotally supported on a frame of the housing 2 by a recessed portion 12. The platen roller 13 is fixed to a center portion of the support shaft in a longitudinal direction. The ring units 14 are respectively fitted to both portions of the platen roller 13 of the support shaft 11 so as to be close to side surfaces 13*a* on both sides of the platen roller 13. The foot portions 25 of the cover 15 are fitted to the ring units 14 on both sides. The ring unit 14 and the foot portion 25 are not in contact with the side surface 13*a* on either side.

Moreover, instead of the ring unit 14, a sliding body using the same material as that of the ring unit 14 may be provided between the side surfaces 13*a* and the foot portions 25 on both sides of the platen roller 13. In this case, the platen roller 13 and the sliding body are in contact with each other. The sliding body and the cover 15 are in contact with each other. Therefore, the cover 15 is rotated between the closed position and the open position by at least one of the sliding friction between the platen roller 13 and the sliding body, and the sliding friction between the sliding body and the cover 15. That is, when the platen roller 13 is positively rotated, the cover 15 is rotated to be positioned at the open position by the sliding friction between the platen roller 13 and the sliding body. When the platen roller 13 is reversely rotated, the cover 15 is rotated to be positioned at the closed position by the sliding friction between the platen roller 13 and the sliding body. In this case, the platen roller 13 and the sliding body, which are positively rotated, configure an entirety or a part of the opening mechanism. The platen roller 13 and the sliding body, which are reversely rotated, configure an entirety or a part of the closing mechanism.

Figure 6:
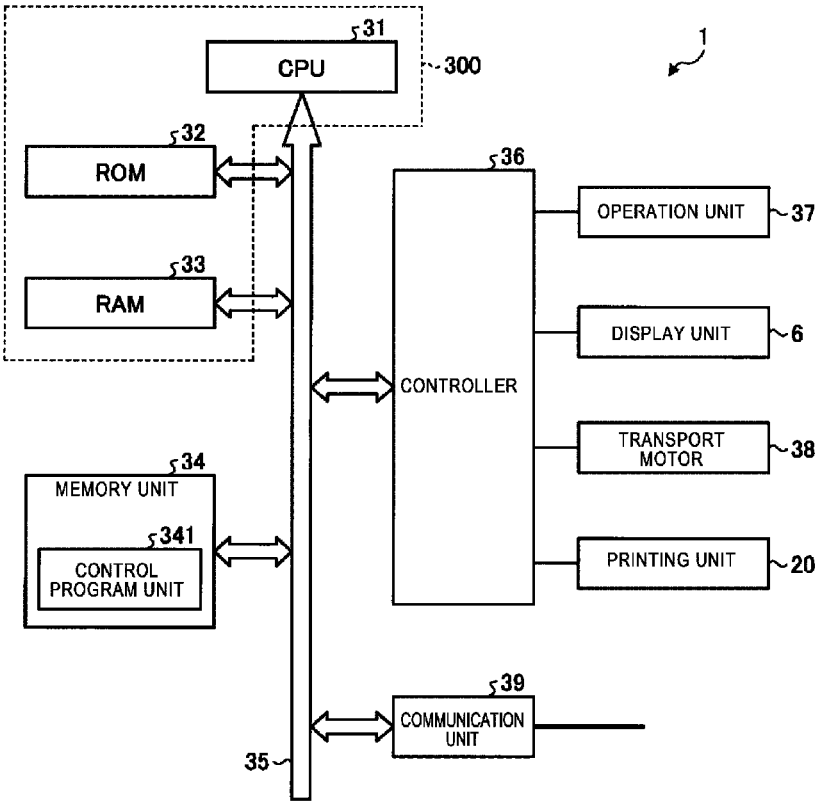
FIG. 6 is a block diagram illustrating a hardware configuration of the portable printer according to the embodiment.

A hardware configuration of the portable printer 1 will be described from here. FIG. 6 is a block diagram illustrating the hardware configuration of the portable printer 1. As illustrated in FIG. 6, the portable printer 1 includes a central processing unit (CPU) 31, a read only memory (ROM) 32, a random access memory (RAM) 33, a memory unit 34, and the like. The CPU 31 is a control subject. The ROM 32 stores various programs. The RAM 33 develops programs or various types of data. The memory unit 34 stores various programs. The CPU 31, the ROM 32, the RAM 33, and the memory unit 34 are connected to each other via a bus 35. The CPU 31, the ROM 32, and the RAM 33 configure the control unit 300. That is, the CPU 31 is operated according to a control program, which is stored in the ROM 32 or the memory unit 34, and is developed in the RAM 33, and thereby the control unit 300 executes control processing which is described below.

The memory unit 34 is configured of a nonvolatile memory such as a hard disk drive (HDD) or a flash memory in which storage information is held even if power supply is turned off. The memory unit 34 stores various types of printing data to be printed. The memory unit 34 includes a control program unit 341 that stores a control program for performing print processing by the control unit 300 based on printing data. The RAM 33 stores the printing data received from an external device (for example, a personal computer, a personal digital assistant (PDA), or a smartphone), and the like.

The control unit 300 is connected to the operation unit 37, the display unit 6, a transport motor 38, and the printing unit 20 via the bus 35 and a controller 36. The operation unit 37 is operated to read the printing data stored in, for example, the memory unit 34. The transport motor 38 is a power source for rotating the support shaft 11. A rotational force of the transport motor 38 is transmitted to the support shaft 11 via a gear or a belt. When the transport motor 38 is rotated in one direction, the support shaft 11 (that is, the platen roller 13) is positively rotated. When the transport motor 38 is rotated in a direction opposite to the one direction, the support shaft 11 (that is, the platen roller 13) is reversely rotated.

The controller 36 receives an instruction from the control unit 300 to control the operation unit 37, the display unit 6, the transport motor 38, and the printing unit 20. However, for the sake of convenience of description, it is described that the control, which is performed by the controller 36, is performed by the control unit 300.

The control unit 300 is connected to a communication unit 39 via the bus 35. The communication unit 39 is communicably connected to an external device carried by the operator via a wireless communication line.

Figure 7:
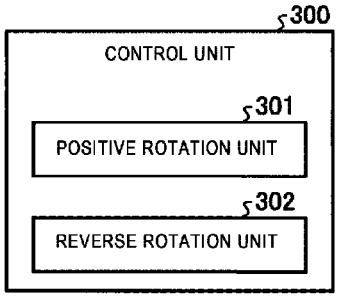
FIG. 7 is a functional block diagram illustrating a functional configuration of the portable printer according to the embodiment.

The control of the portable printer 1 will be described in detail from here. FIG. 7 is a functional block diagram illustrating a functional configuration of the portable printer 1. The control unit 300 functions as a positive rotation unit 301 and a reverse rotation unit 302 by following the control program stored in the ROM 32 or the control program unit 341 of the memory unit 34.

The positive rotation unit 301 includes a function of rotating a rotation body in the discharging direction for transporting the sheet P in the discharging direction.

The reverse rotation unit 302 has a function of rotating the rotation body by a predetermined amount in the opposite direction in order to pull the sheet back to a predetermined position.

Figure 8:
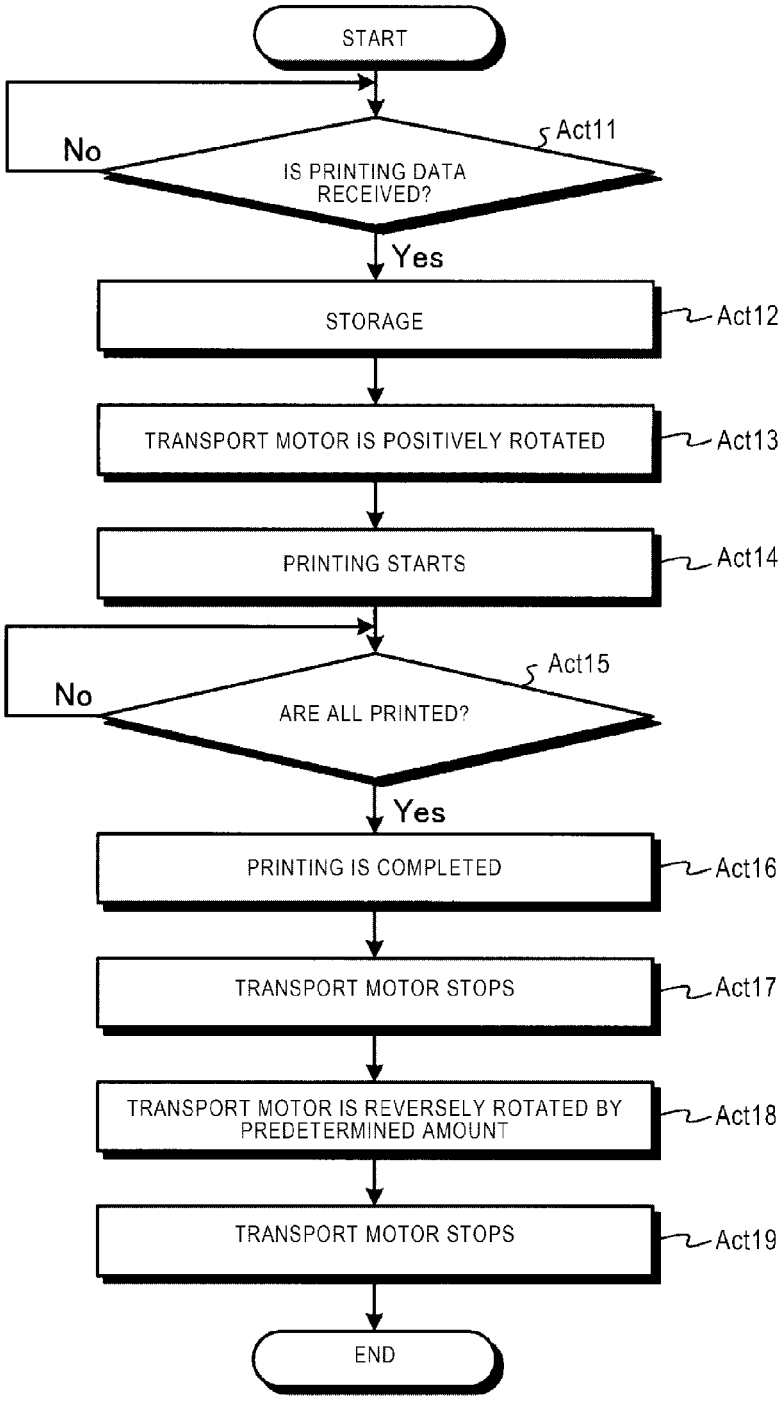
FIG. 8 is a flowchart illustrating control processing of the portable printer according to the embodiment.

FIG. 8 is a flowchart illustrating a flow of control processing of the portable printer 1. As illustrated in FIG. 8, the control unit 300 determines whether or not the printing data is received from an external device (Act 11). The control unit 300 determines that the printing data is received from the external device when the printing data is received by the communication unit 39. The control unit 300 determines that the printing data is not received from the external device when the printing data is not received by the communication unit 39.

If it is determined that the printing data is received from the external device (Yes in Act 11), the control unit 300 stores the received data in the RAM 33 (Act 12). If it is determined that the printing data is not received from the external device (No in Act 11), the control unit 300 waits.

Moreover, when the printing data stored in the memory unit 34 is read by the operation of the operation unit 37, the determination in Act 11 is Yes.

Next, the control unit 300 (positive rotation unit 301) allows the transport motor 38 to be positively rotated (Act 13). Then, the support shaft 11 and the platen roller 13 are positively rotated. When the platen roller 13 is positively rotated, the sheet P is transported in the discharging direction. In this state, the cover 15 is rotated from the closed position to the open position and the discharging unit 22 is opened.

Next, the control unit 300 transmits a printing signal to the printing unit 20 based on the received printing data. That is, the control unit 300 starts printing on the transported sheet P using the printing unit 20 (Act 14). Therefore, the control unit 300 determines whether or not all types of information are printed (Act 15). When the printing signal with respect to the printing data stored in the RAM 33 is transmitted, the control unit 300 determines that all types of information are printed. If it is determined that the printing data, which is not yet transmitted, exists in the RAM 33, the control unit 300 determines that all types of information are not printed.

If it is determined that all types of information are not printed (No in Act 15), the control unit 300 waits until all types of information are printed. If it is determined that all types of information are printed (Yes in Act 15), the control unit 300 completes the print processing (Act 16). Then, the control unit 300 stops the positive rotation of the transport motor 38 (Act 17). In this state, the printed sheet P is discharged from the discharging unit 22 to the outside.

Next, the control unit 300 (reverse rotation unit 302) allows the transport motor 38 to be reversely rotated by a predetermined amount (Act 18). The predetermined amount is an amount required for rotating the cover 15 from the open position to the closed position. When the transport motor 38 is reversely rotated, the support shaft 11 and the platen roller 13 are also reversely rotated. The cover 15 is rotated from the open position and is positioned at the closed position in response to the reverse rotation of the support shaft 11. Then, the opening and closing unit 16 of the cover 15 is entered into the recessed portion 18. The cutter blade 19 attached to the tip of the opening and closing unit 16 is also entered into the recessed portion 18. Therefore, the cover 15 closes the discharging unit 22. The control unit 300 stops the reverse rotation of the transport motor 38 after reversely rotating the transport motor 38 by a predetermined amount (Act 19). Then, the control unit 300 completes the process. When the process is completed, the control unit 300 returns to Act 11 and waits until the next printing data is received.

As described above, when the portable printer 1 of the embodiment performs printing on the sheet P and discharges the sheet P, the ring unit 14, which is the sliding body, is interposed between the rotation body and the cover 15, the cover 15 is rotated and is positioned at the open position by the sliding friction with the ring unit 14 due to the rotation of the rotation body in which the sheet P is transported in the discharging direction. That is, the cover 15 is positioned at the closed position except when printing is performed on the sheet P and the sheet P is discharged. Therefore, even if the portable printer 1 is used, for example, in rainy weather, moisture is unlikely to intrude into the portable printer 1.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, in the embodiment described above, the support shaft 11 and the ring unit 14, which are reversely rotated, are used as the closing mechanism, but are not limited to the embodiment. For example, an elastic member may be provided between the cover 15 and the housing 2 so that the cover 15 receives a biasing force in the arrow Y5 direction in FIG. 4. In this case, when the support shaft 11 is positively rotated, since the sliding friction with the ring unit 14 is greater than the biasing force of the elastic member, the cover 15 is positioned at the open position. When the support shaft 11 is not positively rotated, the cover 15 may be positioned at the closed position by the biasing force of the elastic member. In this case, the elastic member is a part or an entirety of the closing mechanism.

In the embodiment, as an example of the movement of the cover 15, the cover 15 is rotated between the open position and the closed position. However, the movement of the cover 15 is not limited to the embodiment and, for example, the cover 15 may be moved so as to slide between the open position and the closed position.

In the embodiment, the portable printer 1 is described as an example of a printer. However, the printer may be a printer other than the portable printer 1 (for example, a desktop type printer).

Moreover, a program executed by the portable printer 1 of the embodiment is a file of an installable format or an executable format and is provided by being recorded in a computer readable recording medium such as a CD-ROM, a flexible disk (FD), a CD-R, or a digital versatile disk (DVD).

In addition, the program executed by the portable printer 1 of the embodiment may be stored on a computer connected to a network such as an Internet and provided by being downloaded via the network. In addition, the program executed by the portable printer 1 of the embodiment may be provided or distributed via the network such as the Internet.

In addition, the program executed by the portable printer 1 of the embodiment may be incorporated in advance in the ROM or the like.

What is claimed is:

1. A printer comprising:

a housing;

a rotation body that is accommodated in the housing and rotates to transport a sheet;

a printing unit that is provided in a transport path of the sheet and prints information on a transported sheet;

a discharging unit that discharges a printed sheet to an outside of the housing; and a cover that is capable of moving between an open position at which the discharging unit is opened and a closed position at which the discharging unit is blocked, and moves from the closed position to the open position in response to a rotation of the rotation body, wherein the cover is connected to the rotation body via a sliding body having a predetermined frictional force between the rotation body and moves to the open position due to the frictional force by the sliding body between the rotation body, and the rotation body rotates for transporting the sheet in a direction of the discharging unit.

2. The printer according to claim 1, wherein the rotation body has a support shaft that is pivotally supported on an inside of housing and a platen roller that is fixedly provided on the support shaft, rotates in response to a rotation of the support shaft, and transports the sheet, wherein the sliding body is a ring-shaped object that is fitted to an outer peripheral portion of the support shaft, wherein the cover is fitted to an outer peripheral portion of the sliding body, and wherein the cover is moved to the open position by a frictional force generated in at least one of portions between the support shaft and the sliding body, and between the sliding body and the cover in response to the rotation of the rotation body in a discharging direction.

3. The printer according to claim 1, further comprising:

a closing mechanism that causes the cover to move to the closed position when printing on the sheet and discharging of the sheet from the discharging unit are completed.

4. The printer according to claim 3, wherein the closing mechanism causes the cover to move to the closed position due to the frictional force generated in at least one of the portions between the support shaft and the sliding body, and between the sliding body and the cover in response to the rotation of the rotation body in an opposite direction.

* * * * *